United States Patent [19]

Gugel et al.

[11] Patent Number: 5,000,593

[45] Date of Patent: Mar. 19, 1991

[54] MATRIX PIN PRINT HEAD OF THE HINGED-CLAPPER-ARMATURE CONSTRUCTION

[75] Inventors: Bernd Gugel, Ulm-Einsingen; Johann Stempfle, Pfaffenhofen, both of Fed. Rep. of Germany

[73] Assignee: Mannesmann Aktiengesellschaft, Düsseldorf, Fed. Rep. of Germany

[21] Appl. No.: 387,343

[22] Filed: Jul. 28, 1989

[30] Foreign Application Priority Data

Aug. 31, 1988 [EP] European Pat. Off. ..... 88 730 194.3

[51] Int. Cl.[5] ..... B41J 2/28

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,447,166 | 5/1984 | Ochiai et al. | 400/124 |
| 4,548,521 | 10/1985 | Wirth | 400/124 |
| 4,669,898 | 6/1987 | Yeh et al. | 400/124 |
| 4,697,939 | 10/1987 | Ara | 400/124 |
| 4,728,205 | 3/1988 | Hasumi et al. | 400/124 |
| 4,750,259 | 6/1988 | Cattaneo | 29/602 R |
| 4,792,247 | 12/1988 | Sakaida et al. | 400/124 |
| 4,832,515 | 5/1989 | Kawakami | 400/124 |

FOREIGN PATENT DOCUMENTS

| | | | |
|---|---|---|---|
| 3243475 | 2/1990 | Fed. Rep. of Germany . | |
| 0020367 | 2/1982 | Japan | 400/124 |
| 0093169 | 6/1982 | Japan | 400/124 |
| 0174275 | 10/1982 | Japan | 400/124 |
| 0259869 | 11/1987 | Japan | 400/124 |

*Primary Examiner*—Edgar S. Burr
*Assistant Examiner*—John S. Hilten
*Attorney, Agent, or Firm*—Horst M. Kasper

[57] ABSTRACT

A clapper armature (3) is coordinated to each print pin (1) in a matrix pin print head of the clapper armature construction. A magnet yoke (10) is disposed opposite to each clapper armature (3), where one of the two magnet yoke arms (10*a*, 10*b*) is surrounded by an electromagnetic coil (2). The clapper armature (3) is supported between the magnet yoke (10) and an oppositely disposed support bearing (14) for tilting positions, which tilting positions correspond to the withdrawn and, respectively, front position of the print pin (1). The clapper armature (3) or the print pin (1) can be maintained in the withdrawn position in each case with a leg spring (16), where a first spring leg (16*a*) is supported against a print pin head or at the clapper armature (3), and where a second spring leg (16*b*) is supported on a print head case side (4). In order to furnish the clapper armature (3) or the print pin (1), respectively, with a more advantageous guide, the structure of the leg spring (16) has been improved in that all leg springs (16) are connected to each other and form a single-piece leg spring basket (17).

15 Claims, 3 Drawing Sheets

MATRIX PIN PRINT HEAD OF THE HINGED-CLAPPER-ARMATURE CONSTRUCTION

BACKGROUND OF THE INVENTION

1. Field of the Invention

The invention relates to a matrix pin print head of the clapper-armature construction, with a clapper armature coordinated to each print pin, with a magnet yoke disposed opposite to each clapper armature, where one of the two magnet yoke arms is surrounded by an electromagnetic coil, where the clapper armature is supported between the magnet yoke and an oppositely disposed support bearing for tilted positions, which positions correspond to the withdrawn and front position of the print pin, and where the clapper armature or the print pin, in each case, are held with a leg spring in a withdrawn position, where a first spring leg is supported against a print pin head or at the clapper armature, and a second spring leg is supported at a print head case side.

2. Brief Description of the Background of the Invention Including Prior Art

Such clapper armature systems are critical relative to the accuracy and precision of the produced parts and to the thereby resulting functional operating accuracy. An economic production requires relatively large tolerances of the dimensions. In addition, the required mounting and assembly are associated with more or less fixed costs. The clapper armature system is to be precise in its functioning and is to be endowed with a long service life. These contradicting requirements lead again and again to new endeavors to search for system improvements, which lower the production costs, facilitate the mounting and assembly, and increase the service life. In addition, increases in speed, i.e. the actuating frequency, are required.

A clapper armature system of the described kind is known from the German Patent DE 3,243,475 C2. The conventional structure employs individual clapper armatures, supported, as is conventional with this structure, between the magnet yoke and an oppositely disposed elastic O-ring as a support bearing, where each print pin is pressed between a guide bush and a print pin head with a helical spring against the clapper armature, such that the clapper armature is disposed in the rest position, i.e. in the withdrawn position, as long as no current flows in the electromagnet coil. Such a construction leads to a situation where the print pins between the guide bush and the armature engagement position stand fully free and can perform uncontrolled motions, which is a disadvantage.

Another conventional construction, close to the initially designated kind in certain embodiments is known from the German Petit Patent DE-GM 7,827,095. Even though this solution employs already leg springs in lieu of helical springs at the print pin head, even in this case, the lateral guiding of the print pin head is very soft.

SUMMARY OF THE INVENTION

1. Purposes of the Invention

It is an object of the invention to furnish a more advantageous guide to the clapper armature or to the print pin, respectively, by an improved structure of a leg spring.

It is a further object of the present invention to simplify the assembly of springs employed in matrix pin print heads.

It is yet a further object of the invention to facilitate a symmetric disposition of the springs and armatures in matrix pin print heads.

These and other objects and advantages of the present invention will become evident from the description which follows.

2. Brief Description of the Invention

The present invention provides for a matrix pin print head of the hinged clapper armature construction and comprises a set of print pins. Each armature of a set of clapper armatures is coordinated to a corresponding print pin. A magnet yoke of a set of magnet yokes is disposed opposite to a respective clapper armature. Said magnet yokes have a magnet yoke arm. A support bearing for allows the clapper armatures to tilt and is disposed oppositely to the set of magnet yokes. An electromagnetic coil of a set of electromagnetic coils is surrounding a corresponding magnet yoke arm. The clapper armature is supported between the magnet yoke and the oppositely disposed support bearing for tilting positions. Said tilting positions correspond to the withdrawn and front position of the print pin. A single-piece spring basket with leg springs is coordinated to the set of clapper armatures. The leg springs are connected to each other, thereby forming the single-piece leg spring basket. The individual clapper armature and the individual print pin, in each case, are retained in a withdrawn rest position by way of a corresponding leg spring.

A first spring leg can be supported against a respective print pin head. A spring leg can be supported against a respective clapper armature. A second spring leg can be supported at a print head case side.

The spring basket can be fixed at least radially inwardly and at least with the second spring leg at an inner side of a print pin guide case.

The first spring leg can be furnished with a U-shaped guide surrounding an armature cross-section. The U-shaped guide at the flat punched part can be bent up at the first spring leg. The first spring leg can be bent with the finished U-shaped guide toward the second spring leg. The spring basket can be formed from a single-piece, circular-blank-shaped punched part.

According to the present invention, all leg springs are connected to each other and form a single-piece spring basket. The connection of all leg springs results in stiff spring legs and in a high position accuracy of the spring engagement points at the print pin head or, respectively, at the clapper armature. The production of only one single-piece work piece lends itself favorably to a structure comprising 9, 18, or 24 individual and separate leg springs. The mounting of the clapper armature is substantially more advantageous in case of only one single-piece work piece. The spring force can be made available uniformly for all print pins. Thus, the printing impressions of the individual print pins become substantially more uniform than was hitherto obtained by conventional constructions.

According to a feature of the invention, the spring basket is fixed at least radially at the inside and is fixed with at least the second spring leg at the inner side of a print pin guide case. This facilitates the mounting which is more precise, accurate, and quicker than was hitherto possible. In addition, the group of 7, 9, 12, 18, or 24 print pins is fixed more accurately and is precisely guided over the full stroke path during the operation.

An improvement according to the invention comprises that the first spring leg is furnished with a U-shaped guide surrounding the armature cross-section. The spring basket is thus also suitable for the different kinds of pin attachments, where the print pin either rests loosely with the print pin head at the clapper armature or the print pin, without print pin head, is rigidly connected with the clapper armature. Thus, the spring basket can be employed at the clapper armature for differing needle attachments.

Advantageously, the spring basket is formed from a single-piece, circular-blank-shaped punched part. In case of a sheet metal thickness of, for example, from 0.05 to 0.3 mm, it is possible, with a single tool, to punch first the spring legs and subsequently to bend the spring legs into the suitable direction. For a certain diameter, depending on the stretched diameter of the spring legs, there is thus only required a metal band of the recited thickness and width, which metal band can be punched and bent in a multistage operation die such that at the end of the work tool the spring basket is discharged in its finished construction.

Subsequently, the functions of the spring basket in the built-in state can also be taken into consideration during production, in that at the flat punched part the U-shaped guide is bent upwardly at the first spring leg, and in that the first spring leg with the finished, upwardly bent U-shaped guide is bent in a direction toward the second spring leg.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
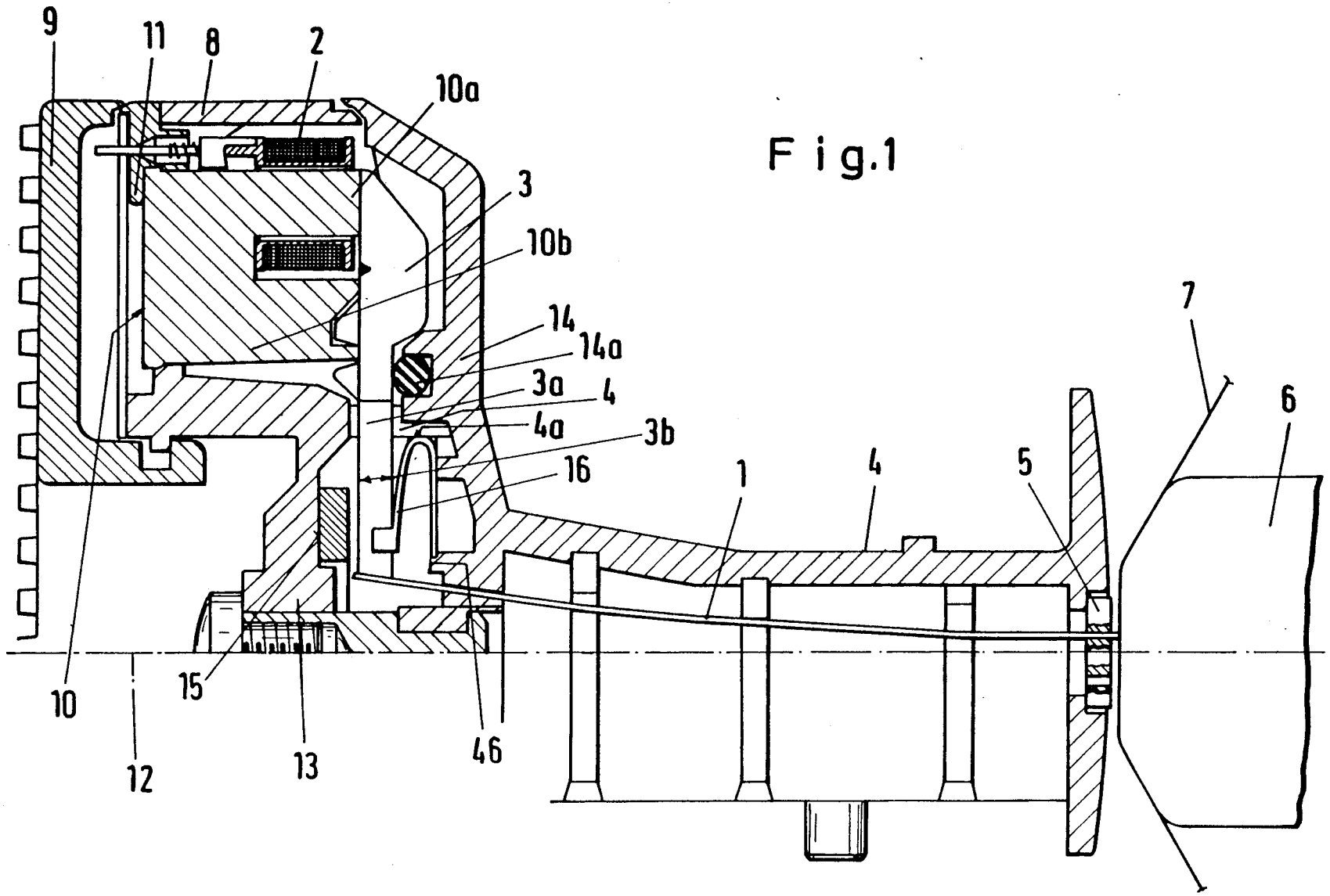
FIG. 1 is an axial sectional view as a half section through the matrix pin print head ready for operation.

In accordance with the present invention, there is provided a matrix pin print head of the hinged clapper armature construction. A clapper armature is coordinated to each print pin. A magnet yoke is disposed opposite to each clapper armature. One of the two magnet yoke arms is surrounded by an electromagnetic coil. The clapper armature is supported between the magnet yoke and an oppositely disposed support bearing for tilting positions. Said tilting positions correspond to the withdrawn and front position of the print pin. The clapper armature or the print pin in each case are retained in a withdrawn rest position by way of a leg spring. A first spring leg is supported against a print pin head or at the clapper armature. A second spring leg is supported at a print head case side. All leg springs 16 are connected to each other and form a single-piece spring basket 17.

The spring basket 17 can be fixed at least radially inwardly and at least with the second spring leg **16*b* at an inner side 4*b* of a print pin guide case 4. The spring basket 17 can be produced from a single-piece, circular-blank-shaped punched part 21**.

The first spring leg **16*a* can be furnished with a U-shaped guide 20 surrounding an armature cross-section 3*b*. The U-shaped guide 20 at the flat punched part 21 can be bent up at the first spring leg 16*a*. The first spring leg 16*a* can be bent with the finished U-shaped guide 20 toward the second spring leg 16*b***.

A matrix pin print head of the clapper armature construction is furnished with an electromagnetic coil 2 and a clapper armature 3 coordinated to each print pin 1. The print pins 1 are disposed in print pin slots with 7, 9, two times 9, 12, or two times 12 print pins and are guided in a print pin guide case 4 in a guide mouthpiece 5, which guide mouthpiece 5 is disposed in stroke distance in front of a print counter support 6. An ink ribbon, not illustrated, is led past the print pins 1, perpendicular to the drawing plane, and a record carrier 7 is guided and transported over the surface of the print counter support 6, where characters or images are generated on the record carrier 7.

A magnet yoke 10 is respectively coordinated to the electromagnetic coil 2 and to each clapper armature 3 in a rear case part 8, closed with a cover 9. The electromagnetic coil 2 surrounds one of the magnet yoke arms **10*a* or 10*b*. The magnet yokes 10 rest in a base plate 11, which is formed as a hub 13 toward the axle center 12**.

Each clapper armature 3 is pivotably supported between a magnet yoke 10 and an oppositely disposed support bearing 14, comprising an elastic O-ring **14*a*. In addition, a damper ring 15 is disposed at the hub 13, where the clapper armature 3, with its radial inner clapper armature arm 3*a* disposed toward the print pin 1, in each case, rests at the damper ring 15** in the withdrawn tilt position.

Figure 3:
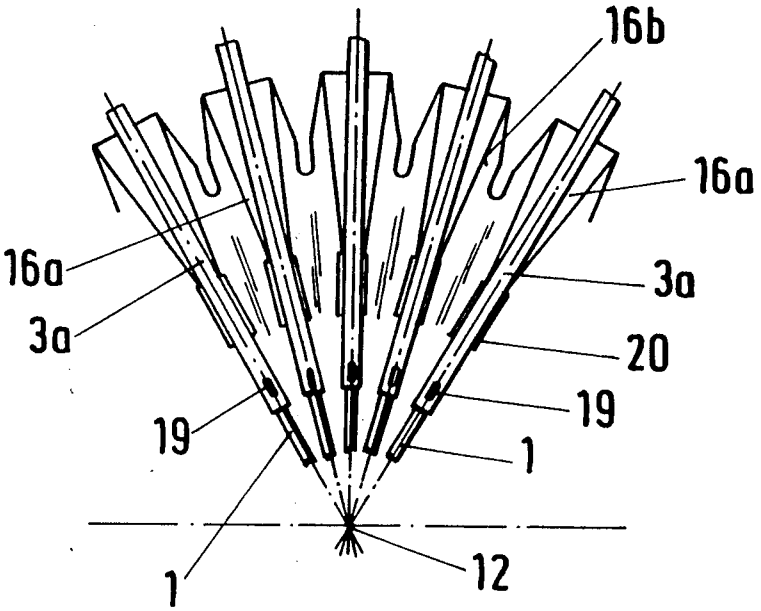
FIG. 3 is a side view, relative to FIG. 2, onto the spring basket with the print pins from behind the print head.
Figure 2:
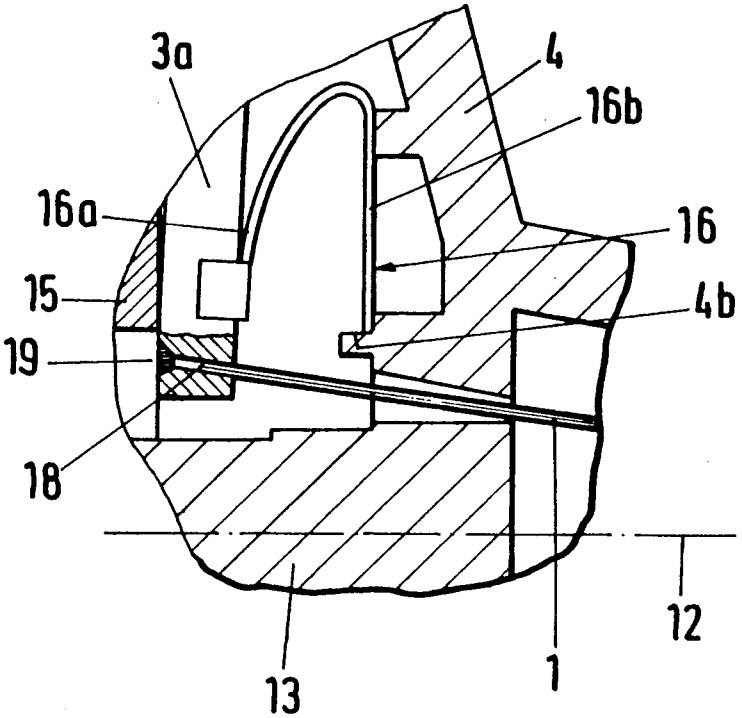
FIG. 2 is a partial sectional view of FIG. 1, at an enlarged scale, in the area of the spring basket.

Each clapper armature 3 is retained in this withdrawn position by way of a leg spring 16, where the leg springs 16 are connected to a single-piece spring basket 17. In the case that the print pin 1, as illustrated in FIGS. 2 and 3, is connected via a bore 18 with weldings 19 to the clapper armature 3 or, respectively, to the radial inner clapper armature arm **3*a*, it is not the print pin 1 which is undergripped with a print pin head, not illustrated, but the clapper armature arm 3*a*** itself.

The leg spring 16, as a member of the spring basket 17, exhibits in each case a first spring leg **16*a* and a second spring leg 16*b*. While the first spring leg 16*a* forms a U-shaped guide 20, which guide 20 surrounds and engages the clapper armature 3, as illustrated in FIGS. 2 and 3, the spring basket 17 rests, at least radially, according to FIG. 1, at a protrusion 4*a* of the print pin guide case 4, and rests with the second spring leg 16*b* at the inner side 4*b* of the print pin guide case 4. The spring basket 17 is adjusted and fixed relating to all these rest positions. The U-shaped guide 20 is dimensioned corresponding to the armature cross-section 3*b*** such that one single armature 3 can be advantageously mounted, assembled, and fixed in position in the guide 20.

Figure 4:
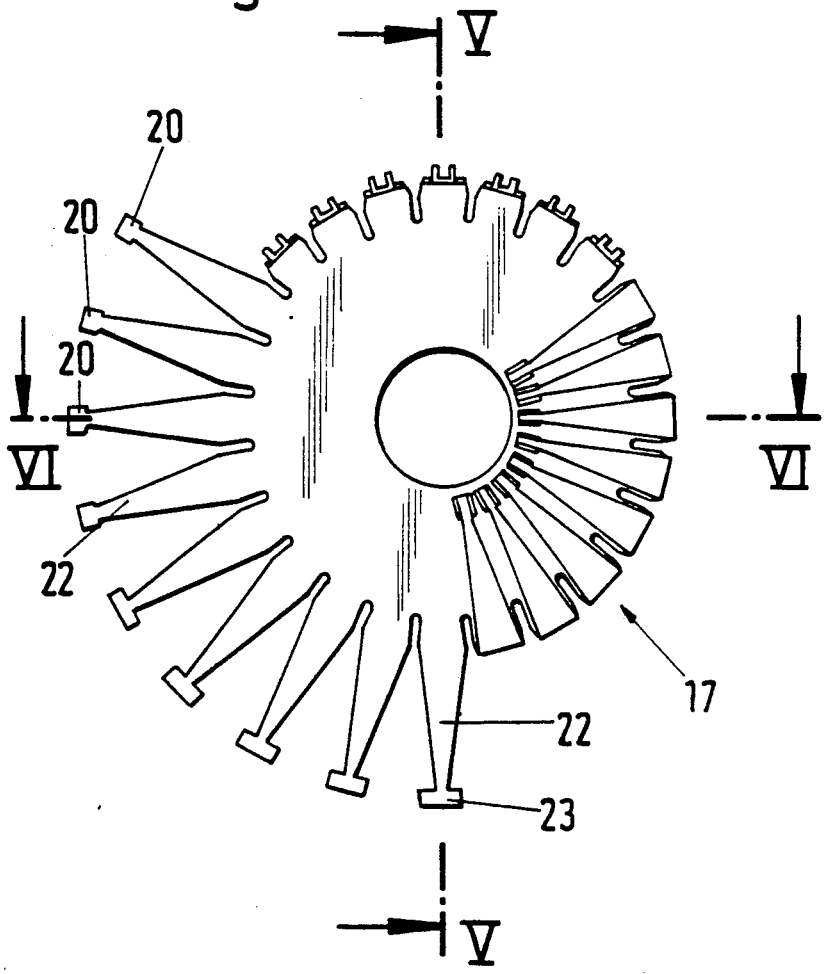
FIG. 4 is a view of the production of the spring basket from a punched part, at an enlarged scale, with production steps distributed along the circumference.
Figure 5:
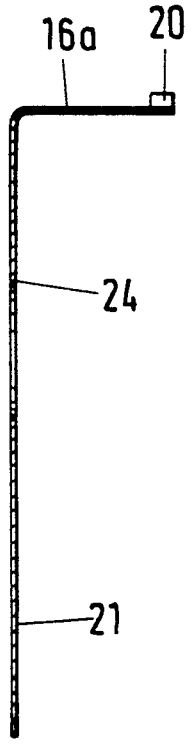
FIG. 5 is a cross-sectional view through FIG. 4, in the direction V—V.
Figure 6:
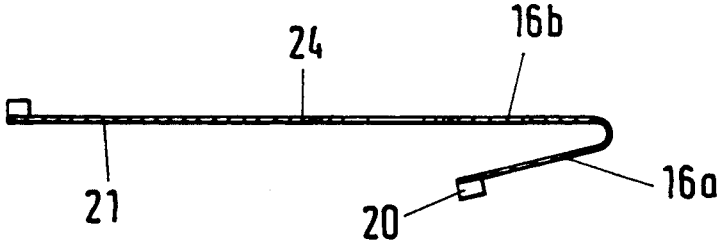
FIG. 6 is a cross-sectional view through FIG. 4, in the direction VI—VI.

The spring basket 17 is produced from one single-piece, circular-blank-shaped punched part 21, as illustrated in FIGS. 4 to 6. According to a first process step, the arms 22 are punched out with protrusions 23 formed on two sides. Initially, the protrusions 23 are bent upwardly at the arms 22 to form U-shaped guides 20. In a further process step, as illustrated in the upper quarter of FIG. 4, the first spring legs 16*a* are formed from the arms 22 by a vertical upward bending of the arms 22, which first spring legs 16*a*, in a last process step, are completely bent inwardly toward a centered circular opening 24, compare right-hand lower quarter of FIG. 4. These process steps produce a completely finished spring basket. The spring basket 17 now exhibits a structure over the full circumference, as illustrated in the right-hand lower quarter of FIG. 4.

The circular blank has cut-out sections for forming the spring legs which have a depth of from about 0.4 to 0.6 of the diameter of the circular blank and preferably from 0.45 to 0.55 of the diameter of the circular blank. The diameter of the circular blank can be from about 3 to 10 times, and preferably from about 4 to 6 times the radius of the center hub of the spring basket. The individual arms 22 are narrowing from the inner cutting end toward the outside such that the diameter can be reduced by a factor of from about 3 to 10 and preferably by a factor from about 4 to 5. The U-shaped guide can have a width which corresponds to 0.5 to 2 times and preferably from about 0.8 to 1.5 times the width of the adjoining spring. The legs of the U have preferably a length which corresponds to from 0.5 to 2 times the width of the spring leg in the immediately adjoining area and preferably from 0.8 to 1.5 times the width of the spring leg in the immediately adjoining area. The spring legs can be bent such that the two ends form a circle, where the circle of the ends with the U-shape is from about 1 to 1.2 times the diameter of the inner opening of the punched ring. The spring punched ring is preferably supported at the support bearing 14 at its inner end corresponding to the opening of the circular blank and in an area adjoining close to the bent-over area, i.e. in an area which has a distance from the inner edge of the circular blank to the outer radius of the full and circumferential, uninterrupted material of the inner blank ring which is from about 0.6 to 0.9 times, and preferably from about 0.7 to 0.8 times the radial extension between the inner opening of the blank and the location of the return bend of the spring basket. Preferably, a further support is provided at the radial outer extremity of the spring basket, in particular in its bending section. The circular blank is preferably disposed about parallel to the surface of the magnets engaging the armature.

In addition to the recesses of the spring legs mentioned above, there is further provided a slot of about a uniform width which forms the end section of the recess openings between the spring legs. The width of the spring leg in the area adjoining the U-shape is preferably from about 0.8 to 2 times the width of a corresponding armature section. Preferably, the armature is furnished with a thickened section in the area near the magnet yoke for allowing increased flux and for reducing magnetic flux resistance in the armature. The thickness can be from about 1.8 to 2.5 times the thickness of the armature in the area outside of the magnet coil.

It will be understood that each of the elements described above, or two or more together, may also find a useful application in other types of spring-supported and circular disposed elements differing from the types described above.

While the invention has been illustrated and described as embodied in the context of a matrix pin print head of the hinged clapper armature construction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A matrix pin print head of a hinged clapper armature construction comprising a set of print pins; a set of clapper armatures, with each armature associated to a corresponding print pin; a set of magnet yokes, each magnet yoke having a first magnet yoke arm disposed opposite to a respective clapper armature, and a second magnet yoke arm; a support bearing for allowing the clapper armatures to tilt said clapper armatures being disposed oppositely to the set of magnet yokes; a set of electromagnetic coils, each magnetic coil of the set of magnetic coils surrounding a corresponding second magnet yoke arm, the clapper armature being supported between the magnet yoke and the oppositely disposed support bearing for tilting between two positions, which positions correspond to a withdrawn and extend position of the print pin; a single-piece spring basket with leg springs holding to the set of clapper armatures, the leg springs being connected to each other thereby forming the single-piece spring basket each leg spring having a first leg portion and a second leg portion joined to set first leg portion by a U-shaped section the individual clapper armature and the individual print pin, in each case, being retained in a withdrawn rest position by way of a corresponding leg spring; further comprising a print head case the second leg portions being supported against the print head case and the first spring leg contacting the armature.

2. The matrix pin print head according to claim 1, wherein the spring basket is fixed at least radially inwardly relative to the circumference of the spring basket, and at least with the second spring leg portion being within the print head case.

3. The matrix pin print head according to claim 1, wherein said first spring leg portions includes a U-shaped guide surrounding an armature cross-section.

4. The matrix pin print head according to claim 1, wherein said first spring leg portion has a U-shaped guide bent up at one end thereof, said U-shaped guide opening away from said second spring leg portion.

5. The matrix pin print head according to claim 1, wherein the spring basket is formed from a single circular shaped punched blank.

6. A matrix pin print head of the hinged clapper armature construction, with a plurality of print pins and a clapper armature associated with each print pin, with a magnet yoke disposed opposite to each clapper armature, each magnet yoke having a first and second arm one of said magnet yoke arms being surrounded by an electromagnetic coil, the clapper armature being supported between the magnet yoke and an oppositely disposed support bearing for tilting between two positions, which positions correspond to the withdrawn and extended position of the print pin, and a leg spring associated with each clapper armature the clapper armature being retained in the withdrawn position by said leg spring, each said leg spring having a first leg portion supported against an end of the armature adjacent the print pin, and a second leg portion supported at a print head case side, and said second leg joined to said first leg portion by a U-shaped section, all leg springs (16) being connected to each other and forming a single-piece spring basket (17).

7. The matrix pin print head according to claim 6, wherein the spring basket (17) is fixed at least radially inwardly and at least with the second spring leg portion (16*b*) inside (4*b*) the print head case (4).

8. The matrix pin print head according to claim 6, wherein the first spring leg (16*a*) portion (16A) has a U-shaped guide (20) surrounding an armature cross-section (3*b*).

9. The matrix pin print head according to claim 6, wherein the spring basket (17) is produced from a single circular shaped punched blank (21).

10. The matrix pin print head according to claim 6, including a U-shaped guide (20) formed at one end of the first spring leg portion (16*a*), the first spring leg (16*a*) being bent toward the second spring leg (16*b*).

11. A matrix pin print head of the hinged clapper armature construction, a print head case, a plurality of print pins movable between extended and withdrawn positions, a clapper armature associated with to each print pin, a magnet yoke having two yoke arms disposed opposite to each clapper armature, one of the two magnet yoke arms being surrounded by an electromagnetic coil, the clapper armature being supported between the magnet yoke and an oppositely disposed support bearing for tilting between two positions, which positions correspond to the withdrawn and extended positions of the print pins, and a leg spring associated with each clapper armature the clapper armature being retained in a withdrawn position by way of its associated leg spring, each leg spring having a first spring leg portions supported by the clapper armature, and a second spring leg portion supported by said print head case said first and second spring leg portions being joined by a U-shaped section, all of said leg springs (16) being connected to each other to form a single-piece spring basket (17).

12. A matrix pin print head of the hinged clapper armature construction, having plurality of print pins movable between extended and withdrawn positions, a print head case, a clapper armature associated with each print pin, a magnet yoke having two yoke arms disposed opposite to each clapper armature, one of said yoke arms being surrounded by an electromagnetic coil, the clapper armature being supported between the magnet yoke and an oppositely disposed support bearing for tilting between two positions, which positions correspond to the withdrawn and extended positions of the print pins, a leg spring associated with each clapper armature the the print pins being retained in the withdrawn position by way of said leg spring, said leg spring each having first spring leg portions supported against one end of its associated clapper armature and a second spring leg portion supported by said print head case side, all said leg springs (16) being connected to each other to form a single-piece spring basket (17).

13. A matrix pin print head of hinged clapper armature construction, a print head case, a plurality of pins movable between extended and withdrawn positions a clapper armature associated with each print pin, a magnet yoke having two yoke arms disposed opposite to each clapper armature, one of two the magnet yoke arms being surrounded by an electromagnetic coil, the clapper armature being supported between the magnet yoke and an oppositely disposed support bearing for tilting between two positions, which positions correspond to the withdrawn and position of the print pins, and a leg spring associated with each clapper armature, each the print pin being retained in a withdrawn position by its associated leg spring, each leg spring having a first spring leg portion supported by the clapper armature, and a second spring leg portion supported by said print head case said first and second leg springs joined by a U-shaped section, all of said leg springs (16) being connected to each other to form a single-piece spring basket (17).

14. A matrix pin print head of hinged clapper armature construction, comprising a plurality of pins movable between extended and withdrawn positions a clapper armature associated with each print pin, a magnet yoke disposed opposite to each clapper armature, two each magnet yoke having magnet yoke arms one of the two magnet yoke arms being surrounded by an electromagnetic coil;

a support bearing, the clapper armature being supported between the magnet yoke and the oppositely disposed support bearing for tilting between two positions, where said positions correspond to the withdrawn and extended positions of the print pins, leg spring including a first and second spring leg portions a print head case;

the leg spring biasing the clapper armature to the withdrawn position, wherein the first spring leg portion being supported against the armature and the second spring leg portion being supported by the print head case said first and second spring legs being joined by a U-shaped section and all of said leg springs (16) being connected to each other to form a single-piece spring basket (17).

15. A matrix pin print head of hinged clapper armature construction, comprising a plurality of pins movable between extended and withdrawn positions a clapper armature associated with each print pin; a magnet yoke disposed opposite to each clapper armature; two each magnet yoke having magnet yoke arms one of the two magnet yoke arms being surrounded by an electromagnetic coil; a support bearing, the clapper armature being supported between the magnet yoke and the oppositely disposed support bearing for tilting between two positions, where said positions correspond to the withdrawn and extended positions of the print pins;

leg spring including a first and second spring leg portions; a print head case; the leg spring biasing the print pin to a withdrawn position;

the first spring leg portion being supported at the clapper armature and, the second spring leg portion being supported by the print head case said first and second spring legs being joined by a U-shaped section and all of said leg springs (16) being connected to each other to form a single-piece spring basket (17).

* * * * *